United States Patent [19]

Andresen

[11] Patent Number: 4,772,504

[45] Date of Patent: Sep. 20, 1988

[54] PRESS FELT

[75] Inventor: Hans Andresen, Tampere, Finland

[73] Assignee: Tamfelt Oy Ab, Tampere, Finland

[21] Appl. No.: 899,169

[22] Filed: Aug. 22, 1986

[30] Foreign Application Priority Data

Aug. 23, 1985 [FI] Finland ..... 853250

[51] Int. Cl.[4] ..... D21F 7/08

[52] U.S. Cl. ..... 428/96; 162/205; 162/358; 162/383; 162/396; 162/DIG. 1

[58] Field of Search ..... 162/205, 358, 383, 396, 162/DIG. 1; 428/96

[56] References Cited

U.S. PATENT DOCUMENTS 3,214,326 10/1965 Lee et al. ..... 162/205
4,439,273 3/1984 Curry ..... 162/358
4,528,239 7/1985 Trokham ..... 428/247
4,537,816 8/1985 Booth et al. ..... 428/247
4,551,377 11/1985 Elves et al. ..... 428/137

*Primary Examiner*—James C. Cannon
*Attorney, Agent, or Firm*—Lowe, Price, LeBlanc, Becker & Shur

[57] ABSTRACT

The invention relates to a press felt for the transportation of a web and for the dewatering thereof in a press part of a paper machine. The press felt comprises at least one needled flock layer formed by fibres. In order to eliminate the re-wetting and the blow effect, a surface layer is formed on or partially within the flock layer at least on one side of the felt. The permeability of the surface layer is substantially lower than that of the rest of the felt beneath the surface layer. The surface layer can be formed by a plastic material applied on the flock layer.

13 Claims, 1 Drawing Sheet

PRESS FELT

BACKGROUND OF THE INVENTION

1. Field of the Invention

The invention relates to a press felt for the transportation of a web and for the dewatering thereof in a press part of a paper machine, said press felt comprising at least one needled flock layer of fibres.

2. Description of the Background

Press felts of this type are today extremely well-known. However, the use of this kind of conventional felts in a press has brought about difficult problems due to effects such as the blow effect and re-wetting. These problems result from the air and water contained in the surface layer of the felt. The blow effect is caused by the air contained in the pores of conventional press felts on the surface thereof and therewithin. When the felt is compressed in the press roll nip, the air is forced out of the surface of the felt through large pores thereof so that the web is lifted off the felt. The re-wetting, in turn, is due to the fact that the felt and the web make contact with each other after the nip effected by the press roll and thus the water contained in the felt can be returned to the web. The re-wetting is aggravated by the presence of large pores and capillaries of the felt surface. These problems set limits to the speed of the paper machine and the linear pressure of the press.

Another disadvantage of needled felts is that the contact face between the web and the felt in the press is uneven because of the irregular formation of the flock layer.

Before the introduction of needled felts, attempts were made to solve this kind of blow and rewitting problems by weaving the surface layer more closely than the layer below it. An example of the prior art would be the structure disclosed in U.S. Pat. No. 3,214,326. However the solution according to U.S. Pat. No. 3,214,326 is not at all applicable to a press provided with needled felts, but only to felts with woven structures.

SUMMARY OF THE INVENTION

The object of the invention is to provide a needled press felt which avoids the disadvantages of previously used needled felts. This is achieved by means of a press felt according to the invention which is characterized in that a surface layer is formed on or partially within the flock layer at least on one side of the felt, the permeability of said surface layer being substantially lower than that of the rest of the felt beneath the surface layer.

The invention is advantageous in that problems caused by the blow effect and re-wetting in connection with prior needled felts can be eliminated virtually altogether. Furthermore, the invention is advantageous in that it is simple, whereby the production costs are very low.

The invention will now be described more closely by means of one preferred embodiment thereof, which embodiment is illustrated in the attached drawing.

DESCRIPTION OF THE PREFERRED EMBODIMENT WITH REFERENCE TO THE DRAWINGS

Figure 1:
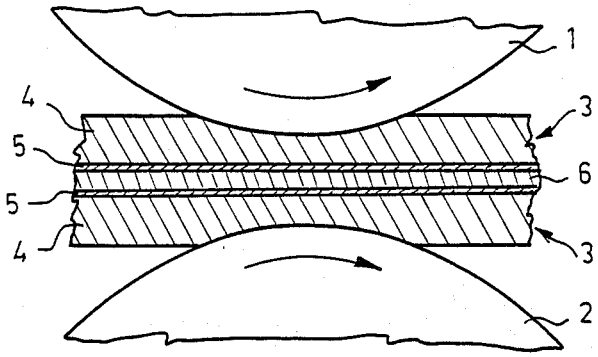
FIG. 1 is a general side view of a press roll nip wherewith felts according to the invention are used.
Figure 2:
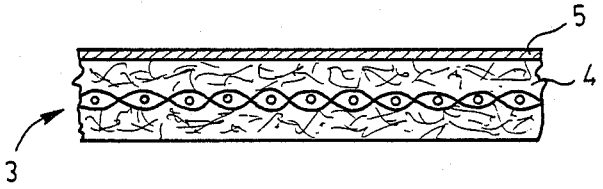
FIG. 2 is a general sectional view of a felt according to the invention.

FIG. 1 shows the principal features of a press of a paper machine. Press rolls are indicated by the reference numerals 1 and 2. Needled press felts are indicated generally by the reference numeral 3 and a web to be dried by the reference numeral 6.

The press rolls 1, 2 of the press shown in FIG. 1 are rotated in the direction shown by the arrows so that the press felts 3 and the web 6 to be dried are displaced from the left to the right in FIG. 1. The web 6 is thereby in a conventional manner positioned between two press felts 3, which receive the water pressed out of the web 6 and transport it away from the nip.

In the embodiment shown in the figures, a surface layer 5 is formed on the flock layer of the felt 3 on that side of the felt which makes contact with the web, the permeability of the surface layer being substantially lower than that of the rest 4 of the felts 3. The surface layer 5 can be formed of a plastic material applied on the flock layer. The permeability of the surface layer 5 preferably ranges from about 0 to about 2 $m^3/m^2/min$, at a pressure of 100 Pa. The above term "surface layer" means the layer positioned on the outside of the felts 3.

This kind of structure prevents the re-wetting of the web and the possible blow effect, because the surface layer 5 makes the surface of the press felt 3 nearly impermeable. The permeability of the surface layer 5, however, is still higher than that of the web 6 to be dried so that the water is transferred from the web 6 to the felt 3 in the press part by the press effect.

The essential aspect of the invention is that the pores of the surface layer of the press felt 3 are filled by means of a sealing material nearly completely and those of the rest 4 of the felt are left open. The tight surface layer 5 prevents the above-mentioned re-wetting and blow effect, because the resistance of water penetration of the surface layer 5 is higher than that of the rest 4 of the felt. The tight surface layer 5 is intended to allow the removal of water from the web, and the rest 4 of the felt, i.e. the part formed of a needled felt, is intended to transport the water therewith. The water does not return into the web through the surface layer 5, because the felt part 4 is more open, whereby the resistance in this direction is respectively smaller.

The tight surface layer 5 also improves the surface of the needled press felt, as a result of which the contact face between the web 6 and the felt 3 is as large as possible, thus helping to improve the smoothness and the printability of the paper.

The tight surface layer 5 can be formed of any plastic material which is applicable on the flock layer. Possible materials are e.g. acrylic resins, styrene butadiene resins, polyvinyl chlorides and polyurethane. The application of the material can be effected by a number of different methods. An example of such methods would be the foam application in which a sealing plastic material is applied to the surface of the felt in the form of a foam by means of doctor blade so that the foam is dispersed into drops onto the surface over a short period of time, thus forming a tight coating. Water-based and paste-like materials can be spread by a doctor blade method known per se or by a lift roll method also known per se. In the doctor blade method the thickness of the surface layer 5 can be adjusted by means of the doctor blade. In the lift roll method, in turn, the thickness of the surface layer 5 can be adjusted by means of the driving speed or the number of revolutions.

The embodiment described above is not intended to restrict the invention in any way, but the invention can be modified within the scope of the claims in various ways. Accordingly, it is self-evident that it is not necessary in practice that a press felt according to the invention is provided on both sides of the web to be dried, but the web can be passed through the press roll nip supported by a single felt. The tight surface layer 5 can be spread on the surface of the felt by any technique. The press felt can, naturally, also comprise more than one needled flock layer of fibres. The surface layer 5 can, of course, be provided on both sides of the felt if such a solution is considered necessary for one reason or another. In this case the permeabilities of the surface layers on different sides of the felt can be chosen completely freely, i.e. the permeabilities of the surfaces can be equal or different from each other. The surface layer 5 can, of course, also be spread on the surface of the felt in such a manner that it is partially forced inside the flock layer, as the essential thing is that the surface layer 5 forms a tight surface for the felt.

I claim:

1. A press felt for the transportation of a web and the dewatering thereof in a press part of a paper machine, said press felt comprising at least one needled flock layer of fibres provided with a surface layer formed on or partially within the flock layer on at least one side of the felt, the permeability of said surface layer being substantially lower than that of the rest of the felt beneath the surface layer.

2. The press felt of claim 1, wherein the surface layer is formed of a plastic material applied on the flock layer.

3. The press felt of claim 1 wherein the permeability of the surface layer ranges from about 0 to about 2 $m^3/m^2/min$.

4. The press felt of claim 2, wherein the permeability of the surface layer ranges from about 0 to about 2 $m^3/m^2/min$.

5. The press felt of claim 1, wherein the one side of the felt where said surface layer is formed has a substantially reduced pore size when compared with the remainder of the felt.

6. The press felt of claim 5, wherein said surface layer has a higher permeability to water than said web and a lower permeability to water than the remainder of the felt.

7. The press felt of claim 2, wherein said plastic material is selected from the group consisting of acrylic resins, styrene butadiene resins, polyvinyl chlorides and polyurethanes.

8. The press felt of claim 1, comprising one surface layer formed on the side of the felt which contacts the web.

9. The press felt of claim 1, comprising first and second surface layers; said first layer formed on the side of the felt which contacts the web, and said second layer formed on the side opposite said web contacting side of the felt.

10. The press felt of claim 9, wherein said first and second layers have the same permeability to water.

11. The press felt of claim 9, wherein said second layer has a lower permeability to water than said first layer.

12. The press felt of claim 1, wherein said surface layer is formed on the surface of the press felt.

13. The press felt of claim 12, wherein said surface layer is further formed within the flock layer of the felt.

* * * * *